US010974925B2

(12) United States Patent
Zach

(10) Patent No.: US 10,974,925 B2
(45) Date of Patent: Apr. 13, 2021

(54) SPINDLE ASSEMBLY FOR A PRINTER FOR ACCOMMODATING PAPER ROLLS OF DIFFERENT SIZES

(71) Applicant: TransAct Technologies Incorporated, Hamden, CT (US)

(72) Inventor: Peter Zach, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 207 days.

(21) Appl. No.: 16/220,420

(22) Filed: Dec. 14, 2018

(65) Prior Publication Data

US 2020/0189873 A1 Jun. 18, 2020

(51) Int. Cl.

| | |
|---|---|
| ***B65H 75/24*** | (2006.01) |
| ***B41J 15/02*** | (2006.01) |
| *B41J 15/04* | (2006.01) |

(52) U.S. Cl.

CPC ..... *B65H 75/24* (2013.01); *B41J 15/02* (2013.01); *B41J 15/042* (2013.01)

(58) Field of Classification Search

CPC ..... B65H 75/24
USPC ..... 400/613
See application file for complete search history.

(56) References Cited

U.S. PATENT DOCUMENTS

| | | | |
|---|---|---|---|
| 2,170,147 | A | 8/1939 | Lane |
| 3,447,409 | A | 6/1969 | Lewis |
| 4,448,101 | A | 5/1984 | Templeton |
| 4,979,838 | A | 12/1990 | Yokota et al. |
| 4,981,059 | A | 1/1991 | Kobayashi |
| 5,174,824 | A | 12/1992 | Salancy et al. |
| 5,243,890 | A | 9/1993 | Ober |
| 5,358,346 | A | 10/1994 | Schmidt et al. |
| 5,531,530 | A | 7/1996 | Kuramoto et al. |
| 5,690,437 | A | 11/1997 | Yanagisawa et al. |

(Continued)

FOREIGN PATENT DOCUMENTS

| | | |
|---|---|---|
| JP | 60161851 | 8/1985 |
| JP | 05278906 | 10/1993 |

OTHER PUBLICATIONS

Pitney Bowes; Accelerated Processing, Digital Mailing System with IntelliLink Technology DM400 Series; Brochure 2008, 4 pages.

(Continued)

*Primary Examiner* — Anthony H Nguyen
(74) *Attorney, Agent, or Firm* — Lipsitz & McAllister, LLC

(57) ABSTRACT

A spindle assembly capable of accommodating paper rolls of varying sizes is provided. The spindle assembly comprises a spindle arm adapted to be connected to a printer mechanism. The spindle arm comprises a first flange surrounding an opening. A spindle is provided for accepting a first paper roll. A first end of the spindle is fixed in the opening of the spindle arm. The spindle comprises a second flange arranged at a second end of the spindle. A sleeve is provided which is adapted to slide over the spindle and attach to the spindle arm for accepting a second paper roll. The second paper roll has a different size than the first paper roll. A printer having such a spindle assembly is provided, as is a method for accommodating different sized paper rolls in a printer.

19 Claims, 6 Drawing Sheets

(56) References Cited

U.S. PATENT DOCUMENTS 5,918,989 A * 7/1999 Stout, Jr. ..... B65C 11/0289 242/563
6,053,648 A * 4/2000 Mistyurik ..... B41J 15/02 347/197
6,158,342 A 12/2000 Moore
6,302,604 B1 10/2001 Bryant et al.
6,367,731 B1 * 4/2002 Takizawa ..... B41J 15/04 242/417.3
6,431,492 B1 8/2002 Chillscyzn
6,503,008 B2 1/2003 Zevin et al.
6,565,273 B2 5/2003 Yamada
6,609,844 B1 8/2003 Petteruti et al.
6,622,622 B2 9/2003 Lee et al.
7,004,462 B2 2/2006 Bryer
7,404,683 B2 7/2008 Mochizuki et al.
7,480,081 B2 * 1/2009 Otsuki ..... B41J 11/009 358/3.28
7,588,811 B2 9/2009 Blank et al.
7,635,230 B2 12/2009 Liao et al.
7,703,998 B2 4/2010 Williams
8,147,155 B2 4/2012 Maekawa
8,231,289 B2 7/2012 Chen
8,950,957 B2 2/2015 Supron et al.
9,315,054 B2 4/2016 Supron et al.
9,367,731 B2 * 6/2016 Vodrahalli ..... G06T 7/11
2003/0077098 A1 * 4/2003 Nunokawa ..... B41J 11/42 400/582
2004/0018035 A1 1/2004 Petteruti et al.
2005/0147451 A1 * 7/2005 Sugimoto ..... B41J 11/009 400/613
2007/0110493 A1 5/2007 Chen
2007/0231043 A1 10/2007 Miyashita et al.
2007/0262141 A1 11/2007 Ito et al.
2008/0258000 A1 * 10/2008 Plociennik ..... B65H 75/24 242/379.1
2009/0114758 A1 5/2009 Yamada
2010/0139467 A1 6/2010 Gutknecht et al.
2011/0076084 A1 3/2011 Kasugai et al.
2011/0284680 A1 * 11/2011 Lin ..... B65H 75/12 242/570
2012/0032021 A1 * 2/2012 Morinaga ..... B65H 75/08 242/577
2012/0155946 A1 6/2012 Colonel et al.
2012/0205418 A1 8/2012 Horie et al.
2013/0243510 A1 9/2013 Supron et al.

OTHER PUBLICATIONS

Transact Technologies Incorporated; Epic 880; Brochure; 2012; 2 pages.
Custom America Inc.; 80MM Receipt/Ticket Printer; Information Sheet and Photos; Jul. 25, 2016.

* cited by examiner

SPINDLE ASSEMBLY FOR A PRINTER FOR ACCOMMODATING PAPER ROLLS OF DIFFERENT SIZES

BACKGROUND OF THE INVENTION

The present invention relates to the field of printers. More specifically, the present invention relates to a spindle assembly for a printer for accommodating paper rolls of different sizes, a printer with a printer mechanism having such a spindle assembly, and methods for accommodating different sized paper rolls in a printer.

Various types of printers that print on paper rolls may be used in different environments that may require different roll widths. For example, printers using paper rolls (e.g., rolls of paper, rolls of label stock, or the like) may include point-of-sale printers, label printers used for inventory control and food preparation, ATM printers, lottery ticket printers, gaming machine printers, and the like. Depending on the environment and application, different width media rolls may be used or required.

Prior art printers may be manufactured with a fixed bucket width for one of several standard-sized paper rolls. Alternatively, prior art printers may accommodate different size paper rolls by using removable screw mounted side guides, manually adjustable side guides, or manually adjustable spindle stops, all which require user adjustment typically using tools before changing roll size.

It would be advantageous to provide a spindle assembly that is easily adapted to accommodate paper rolls of different sizes.

The apparatus and methods of the present invention provide the foregoing and other advantages.

SUMMARY OF THE INVENTION

The present invention provides a spindle assembly for a printer for accommodating paper rolls of different sizes, a printer with a printer mechanism having such a spindle assembly, and methods for accommodating different sized paper rolls in a printer. An example embodiment of a spindle assembly in accordance with the present invention is capable of accommodating paper rolls of varying sizes. Such a spindle assembly comprises a spindle arm adapted to be connected to a printer mechanism. The spindle arm comprises a first flange surrounding an opening. A spindle is provided for accepting a first paper roll. A first end of the spindle is fixed in the opening of the spindle arm. The spindle comprises a second flange arranged at a second end of the spindle. A sleeve is provided which is adapted to slide over the spindle and attach to the spindle arm for accepting a second paper roll. The second paper roll has a different size than the first paper roll.

The second paper roll may have at least one of a different width and a different bore size than the first paper roll. Multiple sleeves of different sizes may be provided to accept additional paper rolls of correspondingly different widths and bore sizes.

The first flange and the second flange may each comprise one of a washer or an integral embossment.

A first end of the sleeve may engage with and be secured to the spindle arm. For example, the first end of the sleeve may comprise extensions that engage with slots or holes in the spindle arm. A second end of the sleeve may comprise a third flange. The third flange may comprise one of a washer or an integral embossment. The first end of the sleeve may fit over and surround the first flange.

The second paper roll may fit between the third flange and the spindle arm. The first paper roll may fit between the first flange and the second flange. The present invention also encompasses a printer with a printer mechanism having a spindle assembly capable of accommodating paper rolls of varying sizes. An example embodiment of such a printer comprises a printer mechanism and a spindle assembly for the printer for accommodating paper rolls of different sizes. The spindle assembly comprises a spindle arm adapted to be connected to the printer mechanism. The spindle arm comprises a first flange surrounding an opening. The spindle assembly also comprises a spindle for accepting a first paper roll, a first end of the spindle being fixed in the opening of the spindle arm. The spindle comprises a second flange arranged at a second end of the spindle. In addition, the spindle assembly comprises a sleeve adapted to slide over the spindle and attach to the spindle arm for accepting a second paper roll, where the second paper roll has a different size than the first paper roll.

The printer mechanism may also include additional features discussed above in connection with the various embodiments of the spindle assembly.

Methods for accommodating different sized paper rolls in a printer are also provided in accordance with the present invention. An example embodiment of such a method may comprise providing a spindle arm adapted to be connected to a printer mechanism, the spindle arm comprising a first flange surrounding an opening, providing a spindle for accepting a first paper roll, a first end of the spindle being fixed in the opening of the spindle arm, the spindle comprising a second flange arranged at a second end of the spindle, and providing a sleeve adapted to slide over the spindle and attach to the spindle arm for accepting a second paper roll, the second paper roll having a different size than the first paper roll.

The method may also include additional features discussed above in connection with the various embodiments of the spindle assembly.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
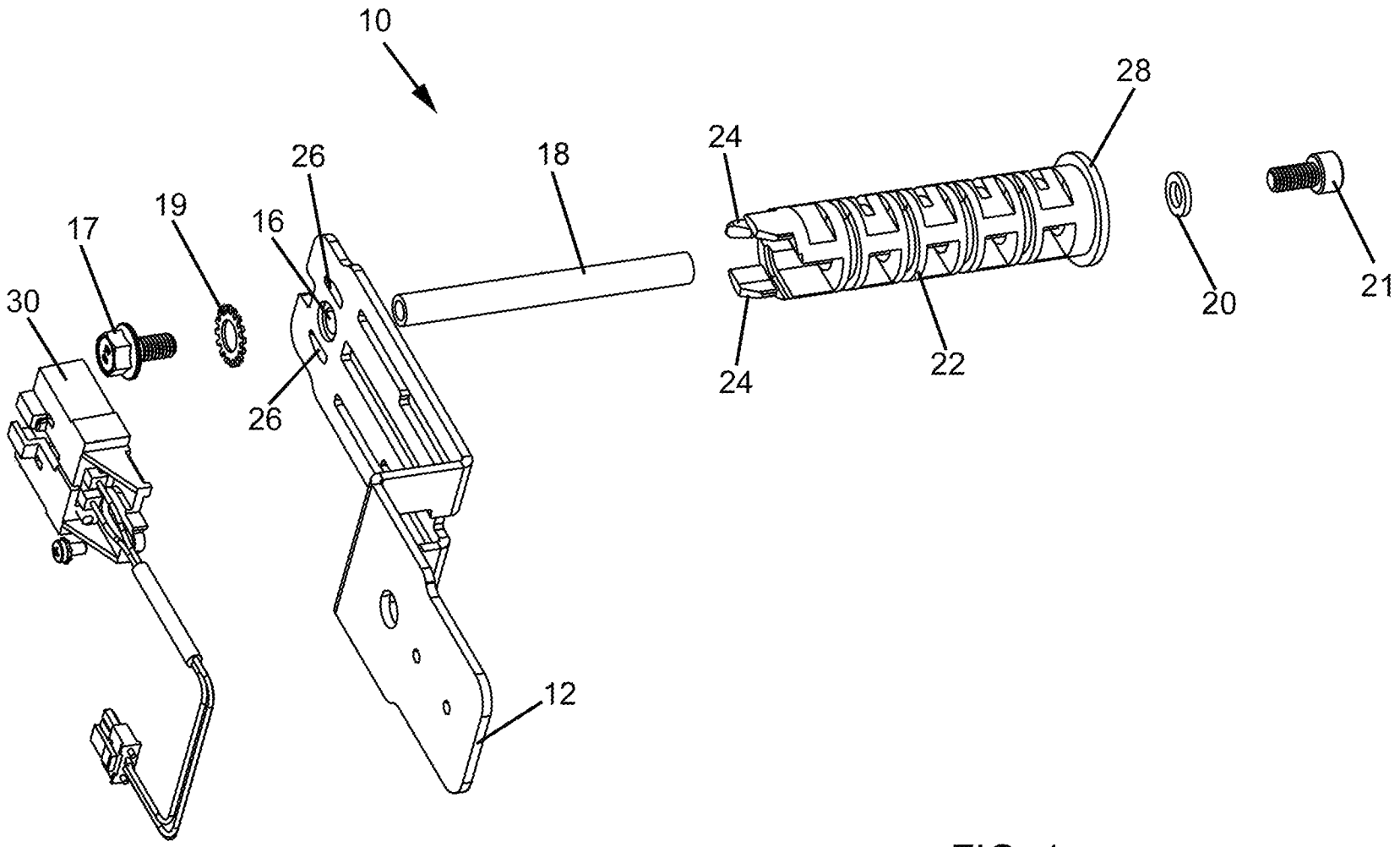
FIGS. 1 and 2 show left and right perspective exploded views of a spindle assembly in accordance with an example embodiment of the invention.
Figure 2:
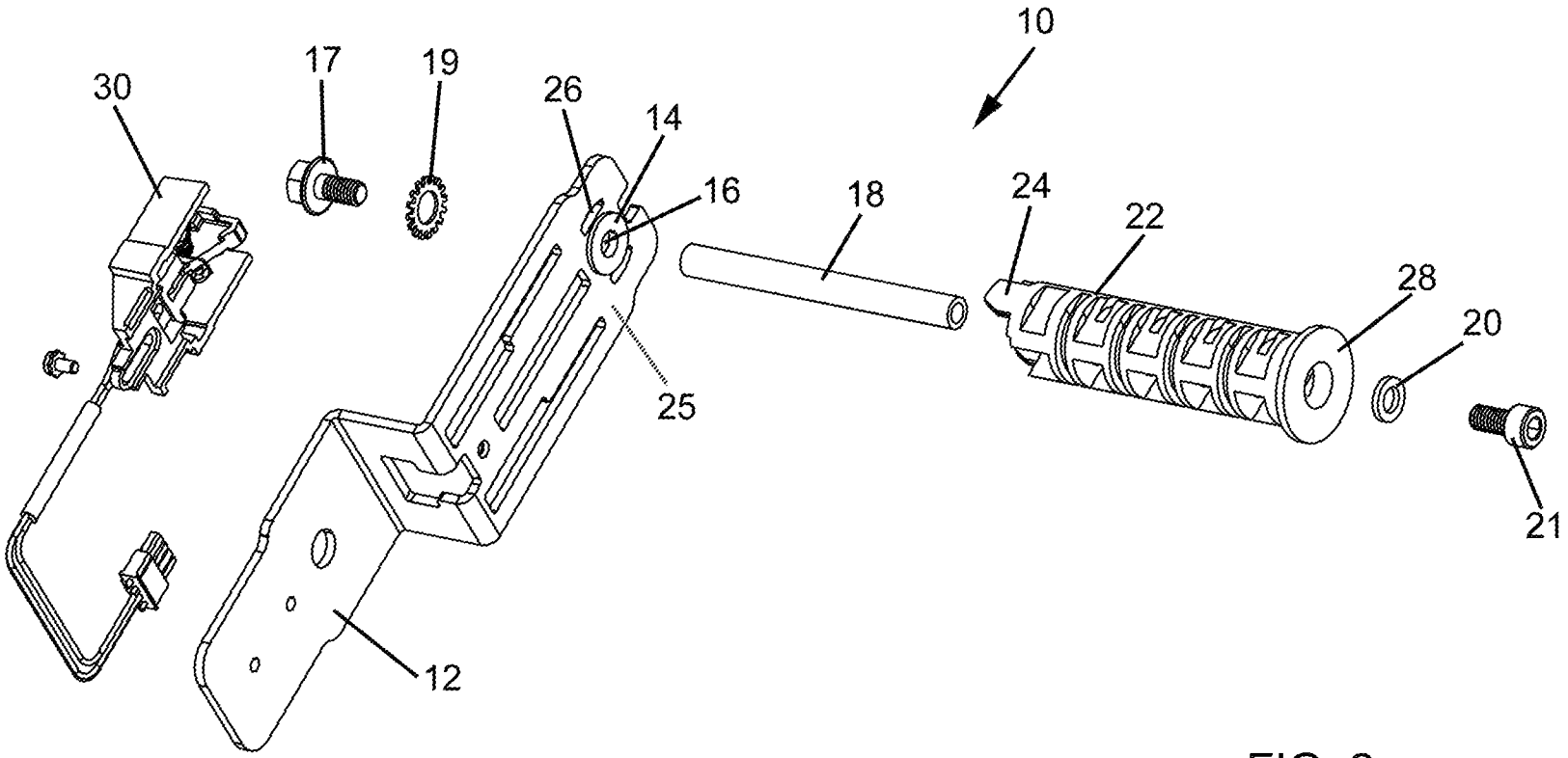
Figure 4:
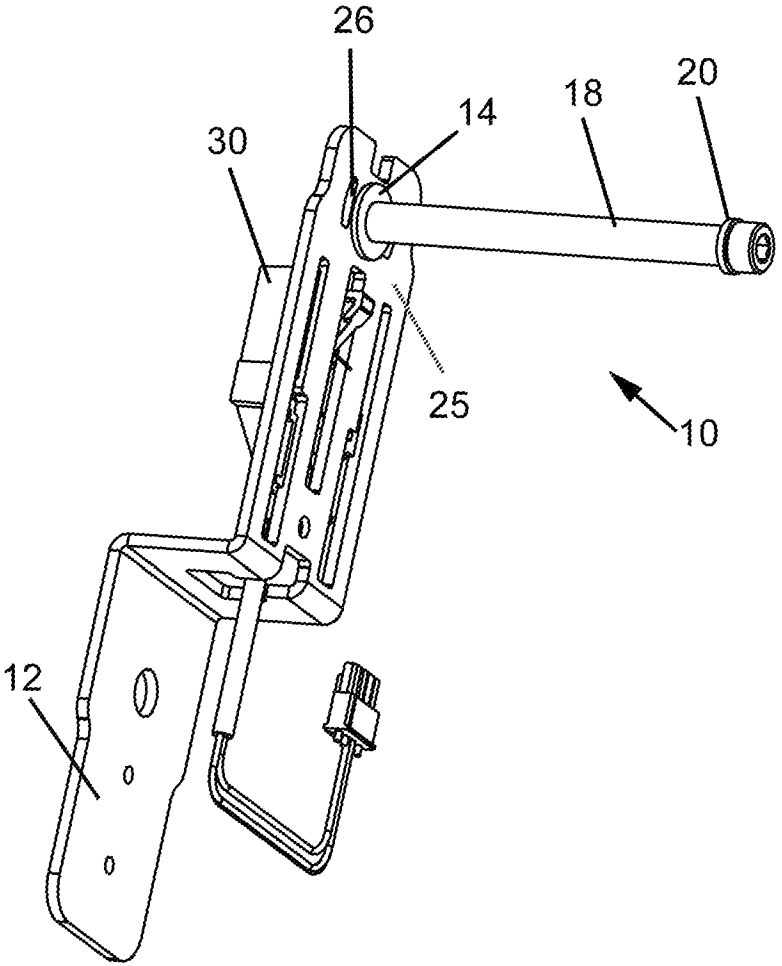
FIGS. 3 and 4 show left and right perspective views of the assembled spindle assembly without the spindle sleeve in accordance with an example embodiment of the invention.
Figure 3:
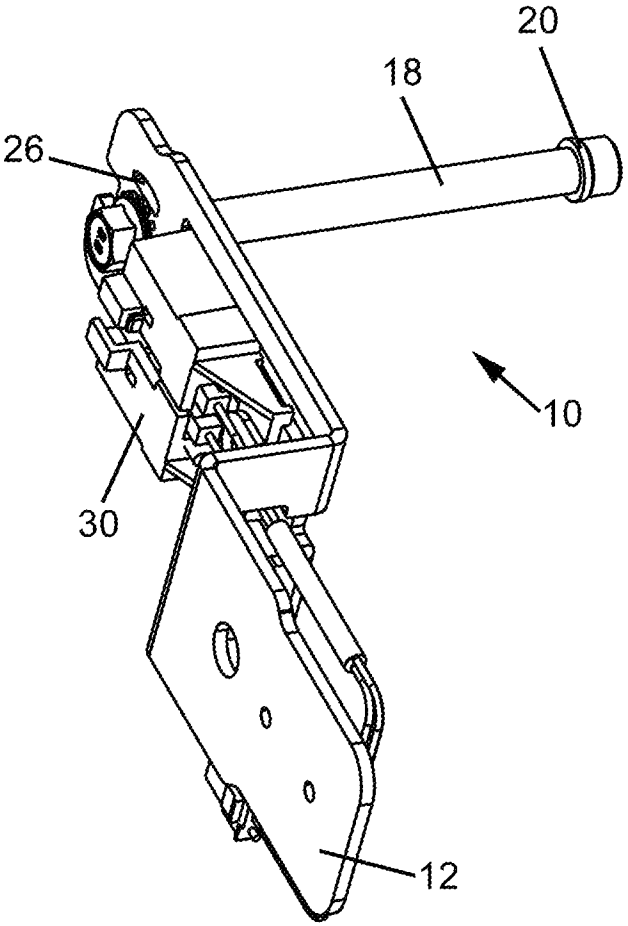
Figure 6:
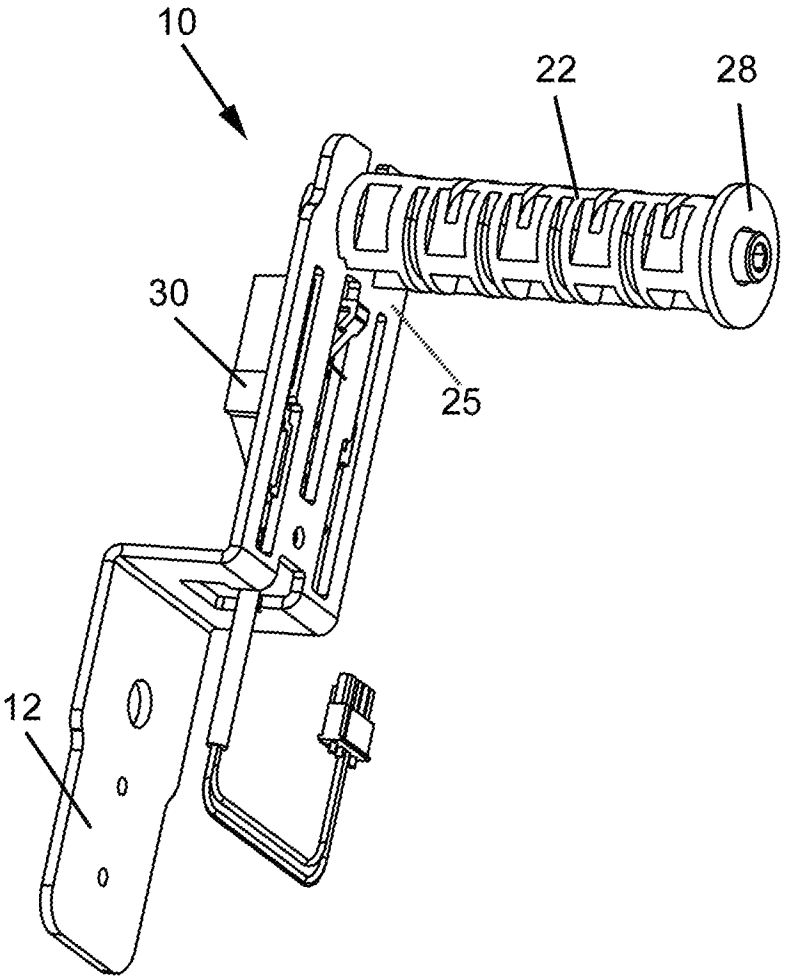
FIGS. 5 and 6 show left and right perspective views of the assembled spindle assembly with the spindle sleeve in accordance with an example embodiment of the invention.
Figure 5:
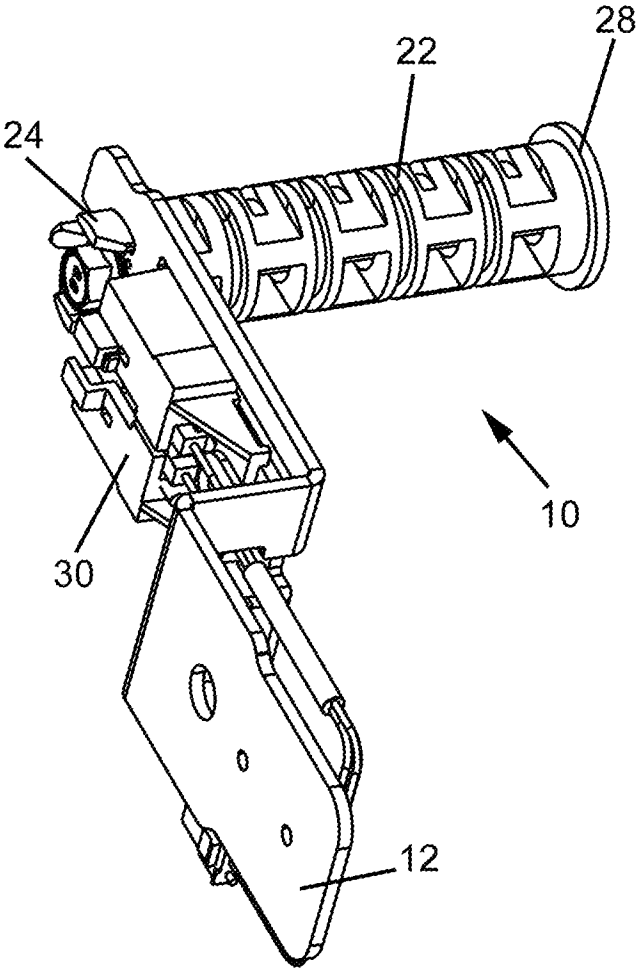

FIGS. 1 and 2 show perspective exploded views of an example embodiment of a spindle assembly 10 in accordance with the present invention which is capable of accommodating paper rolls of varying sizes. FIGS. 3-6 show further views of the spindle assembly 10 and its components.

Figure 8:
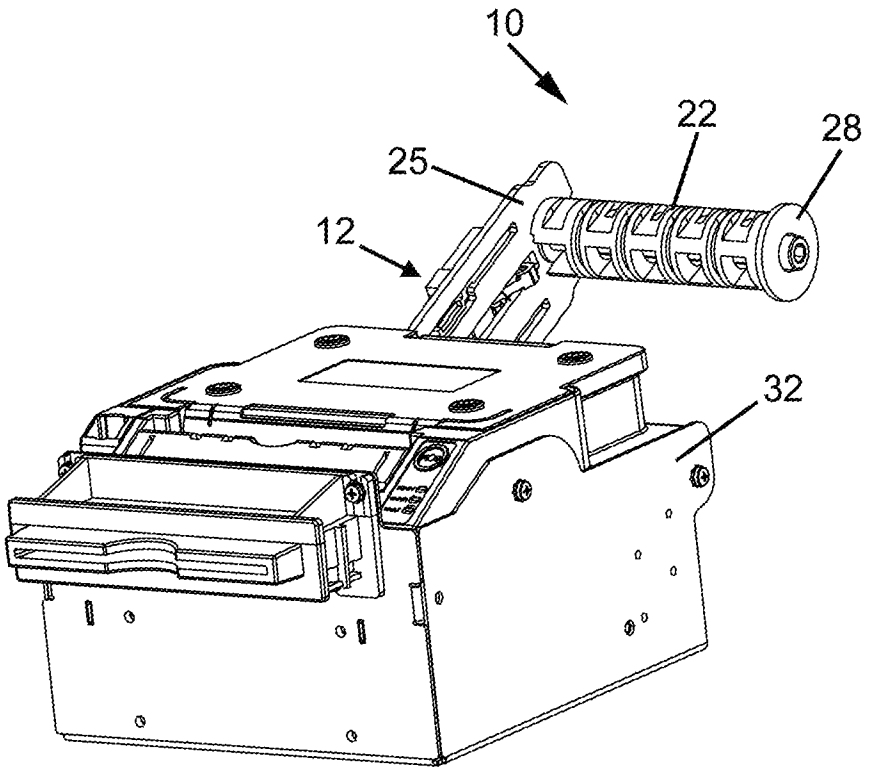
FIG. 8 shows an example embodiment of a printer mechanism of a printer with the spindle assembly with the spindle sleeve in accordance with an example embodiment of the present invention.
Figure 7:
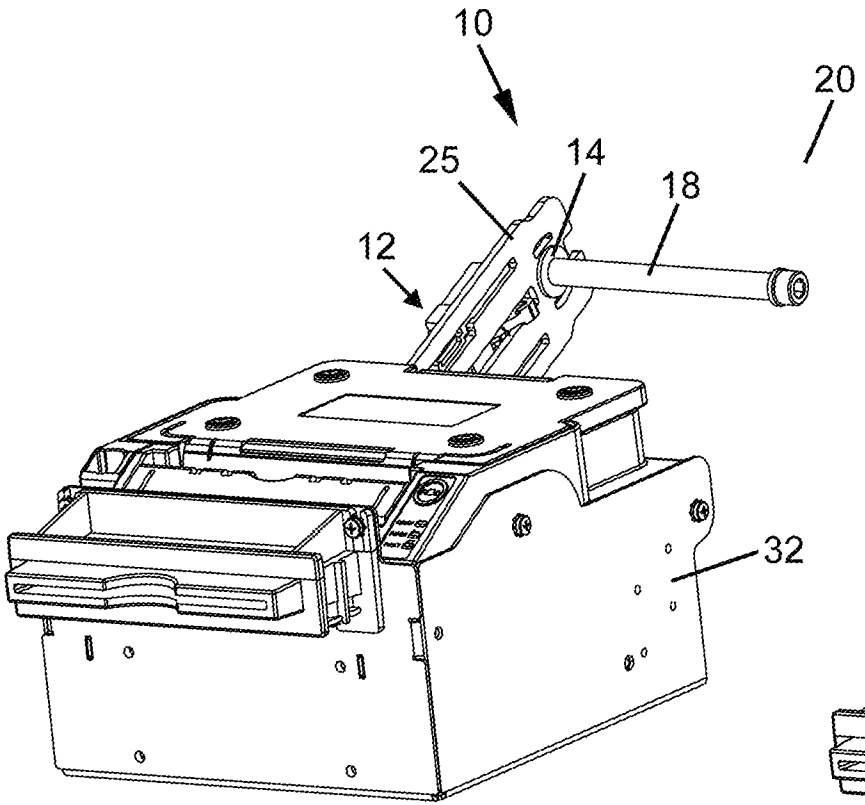
FIG. 7 shows an example embodiment of a printer mechanism of a printer with the spindle assembly without the spindle sleeve in accordance with an example embodiment of the present invention.

The spindle assembly 10 comprises a spindle arm 12 adapted to be connected to a printer mechanism 32 (shown in FIGS. 7 and 8). As shown in FIG. 2, the spindle arm 12 comprises a first flange 14 surrounding an opening 16. A spindle 18 is provided for accepting a first paper roll. As shown in FIG. 2, a first end of the spindle 18 is fixed in the opening 16 of the spindle arm 12 (e.g., via a bolt 17 and washer 19). The spindle 18 comprises a second flange 20 arranged at a second end of the spindle 18. A sleeve 22 is provided which is adapted to slide over the spindle 18 and attach to the spindle arm 12 for accepting a second paper roll. The second paper roll has a different size than the first paper roll.

The second paper roll may have at least one of a different width and a different bore size than the first paper roll.

Multiple sleeves 22 of different sizes may be provided to accept additional paper rolls of correspondingly different widths and bore sizes and to center the different sized paper rolls in the spindle assembly.

A first end of the sleeve 22 may engage with and be secured to the spindle arm 12. For example, the first end of the sleeve 22 may comprise extensions 24 that engage with slots or holes 26 in the spindle arm 12. A second end of the sleeve 22 may comprise a third flange 28. The third flange 28 may comprise one of a washer or an integral embossment. The first end of the sleeve 22 may fit over and surround the first flange 14. In order to install the sleeve 22 on the spindle 18, the sleeve 22 may be slid over the second flange 20 and onto the spindle 18 such that the extensions 24 engage into the slots or holes 26 in the spindle arm 12, with the first end of the sleeve 22 surrounding the first flange 14. The extensions 24 may engage with the slots or holes 26 with a snap fit. The sleeve may be supported at its first end by the extensions 24 that engage with the slots or holes 26 and by the first flange 14, and supported on its second end by the second flange 20. The sleeve 22 can be removed from the spindle 18 simply by pulling the sleeve 22 such that the extensions disengage from the slot or hole 26 and sliding the sleeve 22 off of the spindle 18. Accordingly, in the example embodiment shown in the drawings, the sleeve 22 can be easily installed and removed by hand without tools.

Those skilled in the art will appreciate that there are other ways of attaching the sleeve 22 to the spindle arm 12, including but not limited to screwing the sleeve 22 to the spindle arm 12, a press fit between the second end of the sleeve 22 and the flange 20, or the like. The first flange 14 and the second flange 20 may each comprise one of a washer or an integral embossment. In an example embodiment where the second flange 20 comprises a washer, the second flange may be fixed to the spindle 18 via a bolt 21. The flanges may comprise either metal or plastic. For example, where the spindle arm comprises sheet metal, the first flange 14 may comprise an embossment of the sheet metal. Where the second flange 20 comprises a washer, the washer may be a plastic washer or a metal washer. The sleeve 22 may be made of either metal or plastic. Accordingly, where the third flange 28 is integral to the sleeve 22, it may be made of the same material as the sleeve itself (e.g., metal or plastic).

A paper low sensor 30 may be attached to the spindle arm 12 for sensing when the paper in the printer mechanism 32 is low or has run out.

The present invention also encompasses a printer having a spindle assembly capable of accommodating paper rolls of varying sizes. An example embodiment of such a printer is shown in FIGS. 7 and 8. The printer comprises a printer mechanism 32 and a spindle assembly 10 for accommodating paper rolls of different sizes. The spindle assembly 10 comprises a spindle arm 12 adapted to be connected to the printer mechanism 32. The spindle arm 12 comprises a first flange 14 surrounding an opening 16. The spindle assembly 10 also comprises a spindle 18 for accepting a first paper roll, a first end of the spindle 18 being fixed in the opening 16 of the spindle arm 12. The spindle 18 comprises a second flange 20 arranged at a second end of the spindle 18. In addition, the spindle assembly 10 comprises a sleeve 22 adapted to slide over the spindle 18 and attach to the spindle arm 12 for accepting a second paper roll, where the second paper roll has a different size than the first paper roll.

Figure 10:
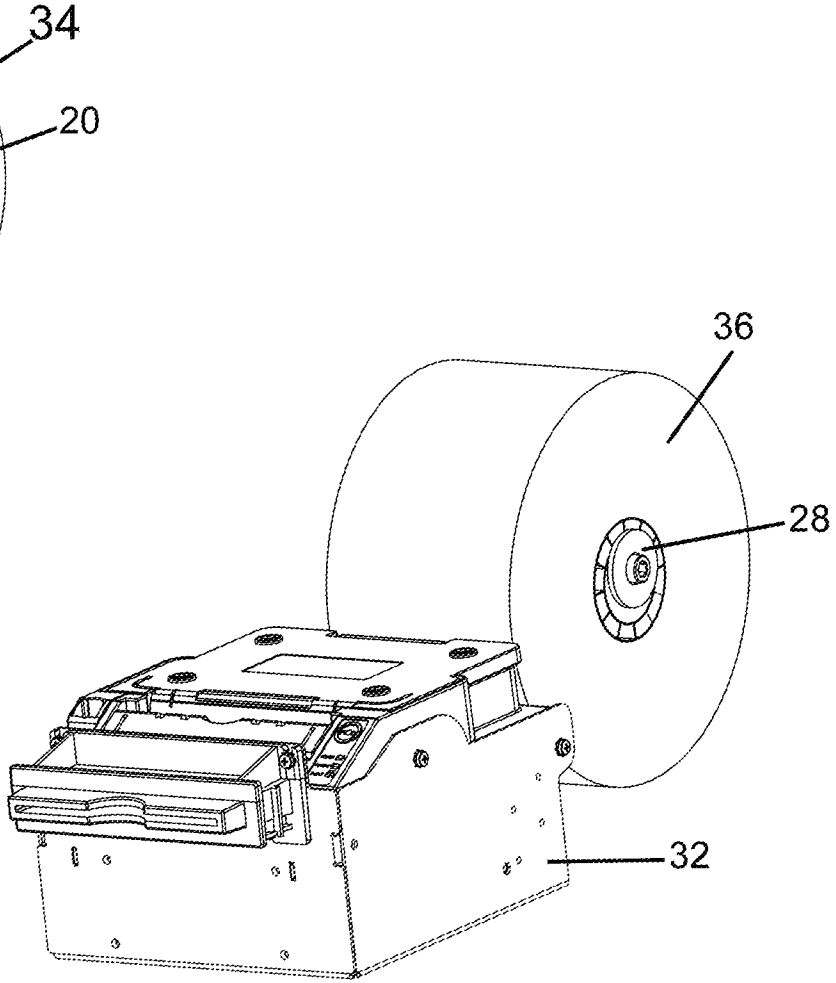
FIG. 10 shows an example embodiment of a printer mechanism of a printer with a second paper roll arranged on the spindle assembly with the spindle sleeve fitted in accordance with an example embodiment of the present invention.
Figure 9:
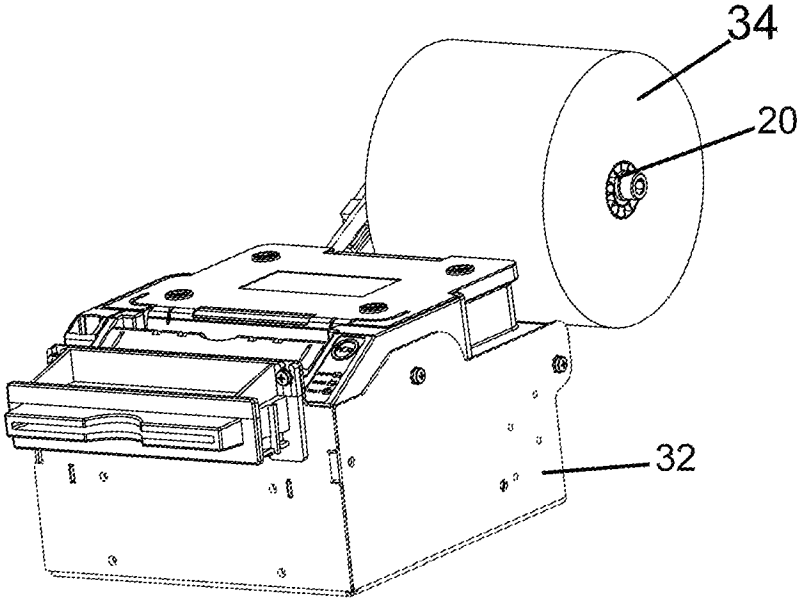
FIG. 9 shows an example embodiment of a printer mechanism of a printer with a first paper roll arranged on the spindle assembly without the spindle sleeve fitted in accordance with an example embodiment of the present invention.

The first paper 34 roll may fit between the first flange 14 and the second flange 20, as shown for example in FIG. 9. The second paper roll 36 may fit between the third flange 28 and a wall 25 of the spindle arm 12, as shown for example in FIG. 10. As an example, the first paper roll 34 may comprise a small (e.g., 80 mm width) paper roll which may fit between the flanges 14, 20 without the sleeve 22 installed, while the second paper roll 36 may comprise a wider (e.g., 82.5 mm width/larger core) paper roll which may fit between the flange 28 on the sleeve 22 and the wall 25 of the spindle arm 12. Those skilled in the art will appreciate that the spindle 18 and sleeve 22 may be designed to accommodate paper rolls of varying sizes, and that the 80 mm and 82.5 mm examples given are not limiting. The arrangement of the spindle arm 12, the sleeve 22 and the flanges 14, 20, and 28 allows the differently sized paper rolls to be centered on the spindle assembly 10.

The paper rolls 34, 36 may be placed on the spindle by sliding the paper rolls 34,36 over the ends of the spindle 18 or sleeve 22, respectively. The bore of the paper rolls 34, 36 is larger than the diameter of the flanges 20, 28, respectively. As the diameter of the spindle 18 is smaller than the diameter of the flange 20, once the paper roll 34 is slid onto the spindle 18 it is retained and centered on the spindle 18 between the flanges 14 and 20. Likewise, as the diameter of the sleeve 22 is smaller than the diameter of the third flange 28, once the paper roll 36 is slid onto the sleeve 22 it is retained and centered on the sleeve 22 between the wall 25 of the spindle arm 12 and the third flange 28.

The printer may also include additional features of the spindle assembly 10 discussed above in connection with FIGS. 1-6.

Methods for accommodating different sized paper rolls in a printer are also provided in accordance with the present invention. An example embodiment of such a method may comprise providing a spindle arm 12 adapted to be connected to a printer mechanism 32, the spindle arm 12 comprising a first flange 14 surrounding an opening 16, providing a spindle 18 for accepting a first paper roll, a first end of the spindle 18 being fixed in the opening 16 of the spindle arm 12, the spindle 18 comprising a second flange 20 arranged at a second end of the spindle, and providing a sleeve 22 adapted to slide over the spindle 18 and attach to the spindle arm 12 for accepting a second paper roll, the second paper roll having a different size than the first paper roll.

The method may also include additional features of the spindle assembly 10 discussed above in connection with FIGS. 1-6.

It should now be appreciated that the present invention provides advantageous methods and apparatus for accommodating paper rolls of varying sizes in a spindle assembly of a printer.

Although the invention has been described in connection with various illustrated embodiments, numerous modifications and adaptations may be made thereto without departing from the spirit and scope of the invention as set forth in the claims.

What is claimed is:

1. A spindle assembly for a printer for accommodating paper rolls of different sizes, comprising:

a spindle arm adapted to be connected to a printer mechanism, the spindle arm comprising a first flange surrounding an opening;

a spindle for accepting a first paper roll, a first end of the spindle being fixed in the opening of the spindle arm, the spindle comprising a second flange arranged at a second end of the spindle;

a sleeve adapted to slide over the spindle and attach to the spindle arm for accepting a second paper roll, the second paper roll having a different size than the first paper roll;

wherein:

a first end of the sleeve engages with and is secured to the spindle arm; and a second end of the sleeve comprises a third flange.

2. A spindle assembly in accordance with claim 1, wherein the second paper roll has at least one of a different width and a different bore size than the first paper roll.

3. A spindle assembly in accordance with claim 1, wherein multiple sleeves of different sizes are provided to accept additional paper rolls of correspondingly different widths and bore sizes.

4. A spindle assembly in accordance with claim 1, wherein the first flange and the second flange each comprises an integral embossment.

5. A spindle assembly in accordance with claim 1, wherein the first end of the sleeve comprises extensions that engage with slots or holes in the spindle arm.

6. A spindle assembly in accordance with claim 1, wherein the third flange comprises an integral embossment.

7. A spindle assembly in accordance with claim 1, wherein the first end of the sleeve fits over and surrounds the first flange.

8. A spindle assembly in accordance with claim 7, wherein the second paper roll fits between the third flange and the spindle arm.

9. A spindle assembly in accordance with claim 1, wherein the first paper roll fits between the first flange and the second flange.

10. A printer, comprising:

a printer mechanism; and a spindle assembly for a printer for accommodating paper rolls of different sizes, the spindle assembly comprising:

a spindle arm adapted to be connected to the printer mechanism, the spindle arm comprising a first flange surrounding an opening;

a spindle for accepting a first paper roll, a first end of the spindle being fixed in the opening of the spindle arm, the spindle comprising a second flange arranged at a second end of the spindle;

a sleeve adapted to slide over the spindle and attach to the spindle arm for accepting a second paper roll, the second paper roll having a different size than the first paper roll;

wherein:

a first end of the sleeve engages with and is secured to the spindle arm; and a second end of the sleeve comprises a third flange.

11. A printer in accordance with claim 10, wherein the second paper roll has at least one of a different width and a different bore size than the first paper roll.

12. A printer in accordance with claim 10, wherein multiple sleeves of different sizes are provided to accept additional paper rolls of correspondingly different widths and bore sizes.

13. A printer in accordance with claim 10, wherein the first flange and the second flange each comprises an integral embossment.

14. A printer in accordance with claim 10, wherein the first end of the sleeve comprises extensions that engage with slots or holes in the spindle arm.

15. A printer in accordance with claim 10, wherein the third flange comprises an integral embossment.

16. A printer in accordance with claim 10, wherein the first end of the sleeve fits over and surrounds the first flange.

17. A printer in accordance with claim 16, wherein the second paper roll fits between the third flange and the spindle arm.

18. A printer in accordance with claim 10, wherein the first paper roll fits between the first flange and the second flange.

19. A method for accommodating different sized paper rolls in a printer, comprising:

providing a spindle arm adapted to be connected to a printer mechanism, the spindle arm comprising a first flange surrounding an opening;

providing a spindle for accepting a first paper roll, a first end of the spindle being fixed in the opening of the spindle arm, the spindle comprising a second flange arranged at a second end of the spindle; and providing a sleeve adapted to slide over the spindle and attach to the spindle arm for accepting a second paper roll, the second paper roll having a different size than the first paper roll;

wherein:

a first end of the sleeve engages with and is secured to the spindle arm; and a second end of the sleeve comprises a third flange.

* * * * *